US006627259B1

(12) United States Patent
Jevons

(10) Patent No.: US 6,627,259 B1
(45) Date of Patent: Sep. 30, 2003

(54) MASKING TAPES AND APPLICATION METHODS

(76) Inventor: Oliver Jevons, 12 Lutyens Close, Macclesfield, Cheshire SK10 3RX (GB)

( * ) Notice: Subject to any disclaimer, the term of this patent is extended or adjusted under 35 U.S.C. 154(b) by 0 days.

(21) Appl. No.: 09/523,252

(22) Filed: Mar. 10, 2000

(51) Int. Cl.[7] ..... B05D 7/14

(52) U.S. Cl. ..... 427/282; 428/40.1; 428/343; 118/504; 118/505; 427/140; 427/142; 427/421; 156/71; 156/94; 156/247; 156/280; 156/293

(58) Field of Search ..... 428/40.1; 118/504, 118/505; 427/140, 142, 282, 421; 156/71, 94, 247, 280, 293

(56) References Cited

U.S. PATENT DOCUMENTS

| | | | | |
|---|---|---|---|---|
| 5,260,097 | A | 11/1993 | Silvestre | |
| 5,547,725 | A | 8/1996 | Barrows et al. | |
| 5,567,239 | A | 10/1996 | Ribic, Jr. | |
| 6,086,709 | A * | 7/2000 | Hills | 156/293 |

FOREIGN PATENT DOCUMENTS

| | | | |
|---|---|---|---|
| DE | 4106960 A1 | | 9/1992 |
| DE | 29601846 U1 | | 4/1996 |
| EP | 0384626 B1 | | 4/1995 |
| GB | 2 298 380 B | * | 9/1996 |
| GB | 2298380 B | | 5/1997 |
| GB | 2327052 B | | 6/1999 |
| WO | WO 9015668 | | 12/1990 |
| WO | WO 9521700 | | 8/1995 |

OTHER PUBLICATIONS

PCT Search Report, Dated Dec. 5, 1999 for application No. PCT/GB98/02706 filed on Aug. 9, 1998.
Abstract of DE4106960 Publication date 09/92.

* cited by examiner

*Primary Examiner*—Harold Pyon
*Assistant Examiner*—Brian Egan
(74) *Attorney, Agent, or Firm*—Dorothy & Manning, P.A.

(57) ABSTRACT

There is disclosed a masking foam tape adapted for use in spraying automobile doors and like openings to prevent penetration of spray through the unsealed gap between the door and the door surround. In one embodiment, the masking foam tape includes an elongate substantially rectangular section having a major dimension at least twice but not more than four times its minor dimension and having at one end of its elongate section adhesive for attachment at the opening. At the opposite end, the elongate section can be tapered and free of adhesive.

22 Claims, 6 Drawing Sheets

MASKING TAPES AND APPLICATION METHODS

BACKGROUND OF THE INVENTION

This invention relates to masking tape for use in spraying automobile doors and the like openings to prevent penetration of spray through the—as yet—unsealed gap between door (or other opening member, such as sun roof) and surround.

Masking tapes for such use are known in various forms made of foam material such for example as polythene, polyester, neoprene and the like. GB 885 660 discloses strip on tape of square cross-section, which is compressed and then fitted into channels provided for subsequent fitting of weather sealing strip. EP 0 365 510 discloses strip of rectangular cross-section as well as strip of circular cross-section with adhesive on one face of the rectangular section embodiment and covering one side of the circular section embodiment.

Widely used are strips which are essentially ribbon-like which are readily folded or bent into a C-cross-section. These ribbon-like tapes have adhesive on one side for attachment to the fixed structure.

Despite the continued development of these masking tapes, problems are experienced in use. For one thing, they need to be applied carefully so as to be correctly positioned. Often, mispositioning is not apparent until the door or other member has been closed and—worse—maybe not even then. Exposed adhesive, for another, prevents absorption and paint builds up which hardens into an edge that has to be rubbed down.

The present invention provides masking foam tapes which do not suffer from these problems.

BRIEF SUMMARY OF THE INVENTION

The invention comprises a masking foam tape adapted for use in spraying automobile doors and like openings to prevent penetration of spray through the unsealed gap between door and door surround, having an elongate, substantially rectangular section having major dimension at least twice but not more than four times its minor dimension and having at one end of its elongate section adhesive for attachment at the opening and being tapered and free of adhesive at the other end thereof.

The adhesive may be only on one face of the tape having the major dimension.

The tapered end may be rounded or faceted, and may be made by extrusion through an appropriately shaped die or by crush cutting and thereby cold welding so as to make two tapes out of a single wider tape, each with a cold welded, rounded edge.

The tapered end may be on a lateral projection, which may be, in length, substantially the same as the minor dimension of the substantially rectangular section.

The tape may have adhesive as one face only, the lateral projection being from that face.

The lateral projection may be necked.

The tape may have adhesive on one face only, and lateral projections from both faces.

The tape may have its substantially rectangular section slightly tapered towards its adhesive end so as to have (except for its adhesive-free, tapered end) a slightly trapezoidal section.

A tape, even without a lateral projection, may be necked at its tapered adhesive-free end.

Conventionally, automobile doors, when sprayed in situ in the door surround, are masked by a self-adhesive foam masking strip or tape which is adhered around the surround, the door being then closed on it to trap the strip so as to prevent ingress of spray paint into the automobile interior. If two coats—primer and top coat—are to be applied, best practice requires that the mask be peeled off and any hard edges of primer rubbed down before re-masking and top coat application. A problem arises, when primer and top coats are being applied, in that on surfaces within the gap between the edge of the door and the surround, the area covered by the primer is not necessarily the same as that covered by the top coat, which leaves an untidy appearance.

The present invention provides a method for masking during painting and a masking tape for use therein, avoiding these problems.

The invention also comprises a paint masking strip comprising a body part with adhesive for attachment to a workpiece and a readily separable part.

The separable part may comprise a tear-off part, which may be integral with the body part, joined by a thin web or adhesively attached to the body part.

The body part may have an oblong cross-section with a strip of adhesive at one edge of a wider face, the separable part being at the other edge of said face. The ratio of the width of the wider and narrower faces may be between 2:1 and 5:1. The body part may be tapered at the said other edge.

The tear-off part may be a bead of width equal to the width of the narrower face of the body part.

The body part may have a lateral projection from the face which bears the adhesive and at the opposite edge of said face, and the separable part may then be on that projection.

The strip may, however, comprise a readily foldable ribbon-like body part, the removable part being along one face thereof, intermediate its edges. The removable part may comprise a bead which is narrow by comparison with the width of the body part. The bead may be closer to one edge of the strip than the other, and the said one edge may have an adhesive strip on the same face as the bead. The opposite face of the body part may have an adhesive strip at its opposite edge.

The strip may be made of open-cell foam material.

The invention also comprises a method for masking an unsealed automobile door or like opening for spraying, comprising attaching a tape according to the invention above-stated around the inner edge of the open door or other opening member to project around the door or member beyond the rim thereof and closing the door or member to position the projecting part of the tape between door or member and surround, and, where necessary, subsequently adjusting the said part of the tape to be evenly accommodated around the rim.

As the tapered edge of the tape, which is effectively the sealing portion thereof being, when closed on, trapped between the surround and the door or other member rim, has no adhesive, it can readily be adjusted—the trapping action leaving scope for manual adjustment where the foam might project too far out of the gap, or not far enough. Moreover, the whole exposed surface is absorbent and causes no hard edge formation, saving a rubbing-down operation which is time consuming.

The invention also comprises a method for masking during painting the outer face of a door in a door surround comprising attaching a mask between door and surround to seal against penetration of paint through the door opening, the masking having a readily removable part which protrudes from between the edge of the door and the surround, painting the door and surround with a first coat of paint, removing the readily removable part of the mask, then painting the door and surround with a second coat of paint.

The mask may be adhesively attached to the door which is then closed to trap the mask between door and surround.

Foam masking tapes are usually supplied in roll form. In order to attach to the vehicle they are provided with an adhesive strip, perhaps more than one. In roll form, there is, however, a tendency for the adhesive to adhere to the adjacent layer of tape on the roll. This tendency can of course be counteracted by winding the roll with an interleaved release paper, which is, on use of the tape, wastefully discarded and which might well interfere with the efficient use of the tape. The other method for avoiding interlayer adhesion is so to adjust the tack of the adhesive that it does not adhere to the adjacent foam layer at the interlayer pressure in the roll, yet adheres satisfactorily to the vehicle's surface. This requires control of both tack and winding tension with obvious opportunities for error and customer complaint. Another factor is, of course, shelf life, the adhesive characteristics being required to change within but narrow limits during a reasonable shelf life and, for best practice, the imposition of some system of stock control, with sell-by and use-by dates to be taken into account by both distributor and end-user.

The present invention provides a solution to these problems.

The invention comprises a compressible foam product stored in layers and having an adhesive by which it is adapted, in use, to be attached to a surface, the adhesive being so arranged as to be between adjacent layers but out of contact with the next adjacent layer in the store.

The layers may be layers of a roll of strip or sheet foam material, or layers of a stack of strip or sheet foam material pieces.

The adhesive may be contained within a depressed region or regions of the product, or may face a depressed region or regions of the product, so as to remain out of contact.

When the product is a paint masking tape the adhesive is usually in the form of a length-wise strip, which may, according to the invention, be in a groove of the material or opposite a groove of the next adjacent layer in the roll or stack.

Clearly, when the adhesive is on the surface, against a corresponding depression in the adjacent face in the roll or stack, there is no problem whatever in use.

When the adhesive is itself sunk in a groove, it is only necessary that ordinary pressure for application of the material to the desired surface pops the adhesive out to contact the surface and the tack is sufficient to hold the adhesive in position against any resilience of the foam, the other normal requirement, of course, being that the material, its job done, can be stripped from the surface.

BRIEF DESCRIPTION OF THE DRAWINGS

Embodiments of foam products comprising masking foam tapes and methods for masking using the same will now be described with reference to the accompanying drawings, in which.

DETAILED DESCRIPTION OF THE INVENTION

Figure 1:
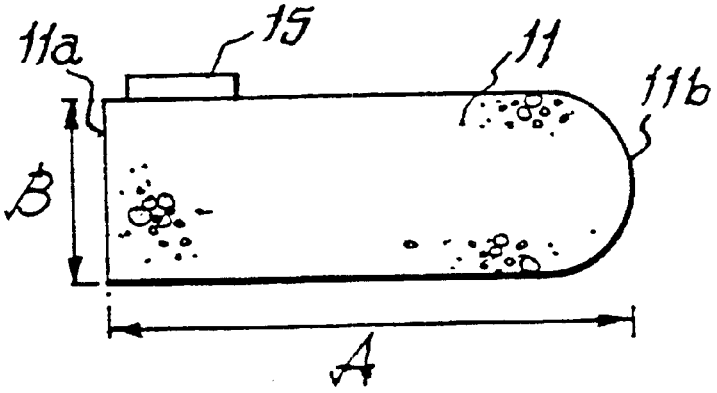
FIG. 1 is a cross section of one embodiment.
Figure 2:
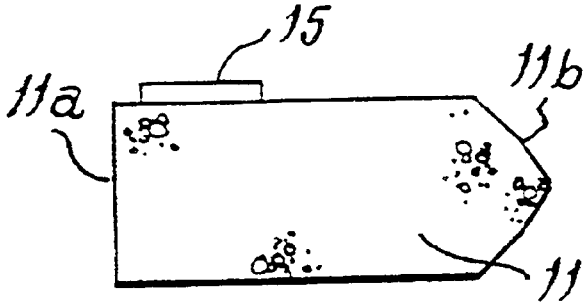
FIG. 2 is a cross-section of another embodiment.
Figure 3:
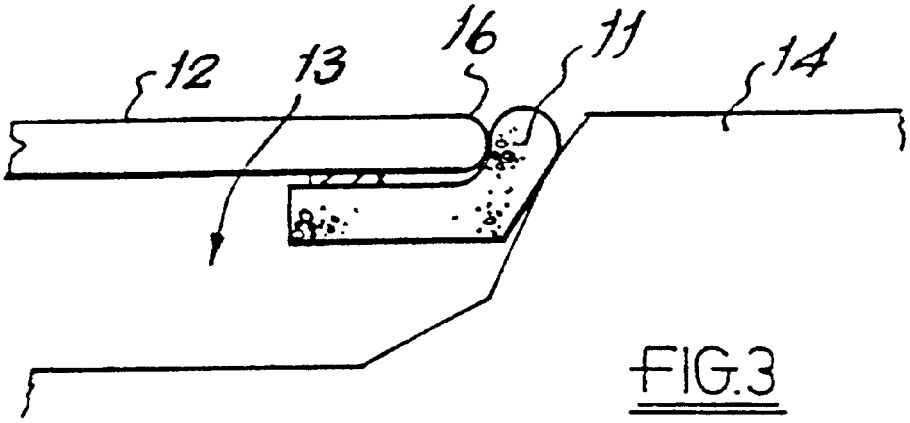
FIG. 3 is a diagrammatic section showing a tape according to FIG. 1 in position between a door and a door post of an automobile.

FIGS. 1 to 3 illustrate a masking foam tape 11 adapted for use in spraying automobile doors 12 and like openings to prevent penetration of spray through he unsealed gap 13 between door 12 and door surround (post 14, FIG. 3). The tapes 11 have elongate substantially rectangular sections having major dimension A at least twice but not more than four times its minor dimension B and having at one end 11*a* of its elongate section adhesive 15 for attachment at the opening and being tapered and free of adhesive at the other end 11*b* thereof.

Typical values for A and B are 25 mm and 10 mm respectfully.

The adhesive 15 is confined to a thin strip along one face of the tape 11 having the major dimension A. The strip may be, say, 2 mm in from the edge and some 8 mm wide.

The tapered and in FIG. 1 is rounded, in FIG. 2, faceted—generally, the cross-section is that of a bullet.

FIG. 3, shows how the tape 11 of FIG. 1 (FIG. 2 would be the same) is applied by attaching it by its adhesive strip 15 around the inner edge 16 of the door 12 so as to project, by its adhesive-free tapered edge 11*b*, around the door 12 beyond the rim thereof and closing the door 12 to position the projecting part between door 12 and surround 14.

As there is no adhesive in the region where the foam is trapped, any mispositioning may be readily adjusted by manually or perhaps automatically repositioning the tape—modest finger pressure suffices, but, of course, a robotic mechanism could be trained to do this.

With the dimensions quoted, no difficulty is experienced in bending the strip to conform to a corner.

Figure 4:
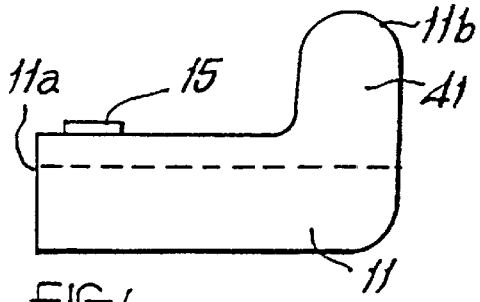
FIG. 4 is a section of another embodiment having a lateral projection.
Figure 10:
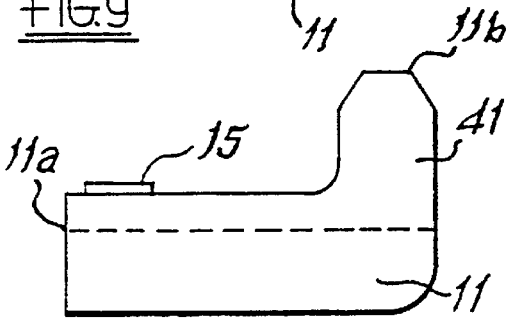
FIG. 10 is another section having a faceted lateral projection.
Figure 8:
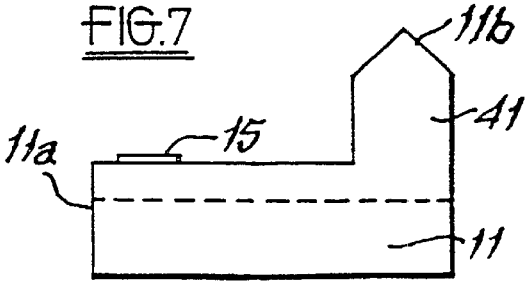
FIG. 8 is a section having a gaceted lateral projection.

FIG. 4 shows a tape generally like that of FIG. 1, but with a lateral projection 41 on the same face as the adhesive 15. FIGS. 8 and 10 show similar arrangements but with faceted instead of rounded tapered ends 11*b* on lateral projection 41.

Figure 6:
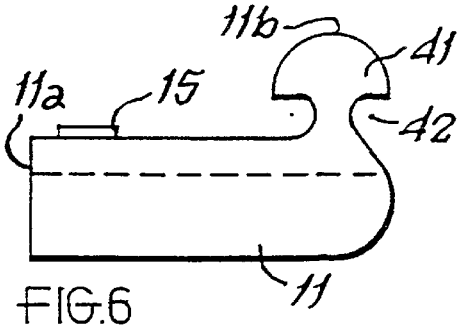
FIG. 6 is a section having a necked lateral projection.
Figure 11:
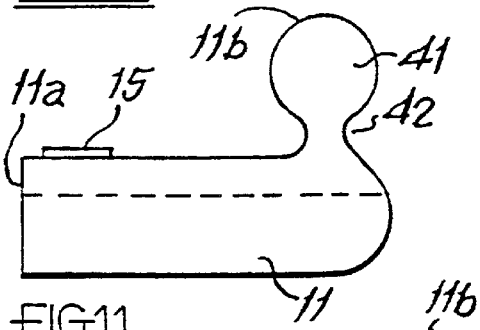
FIG. 11 is another section having a necked lateral projection.

FIGS. 6 and 11 show tapes in which the lateral projection 41 is necked at 42.

Figure 7:
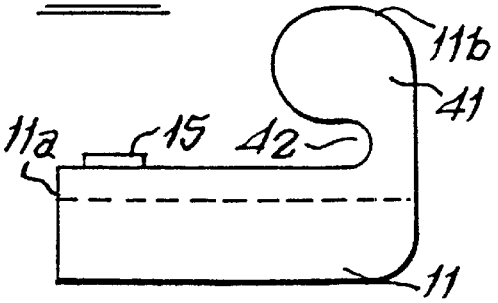
FIG. 7 is another section having a necked lateral projection.
Figure 12:
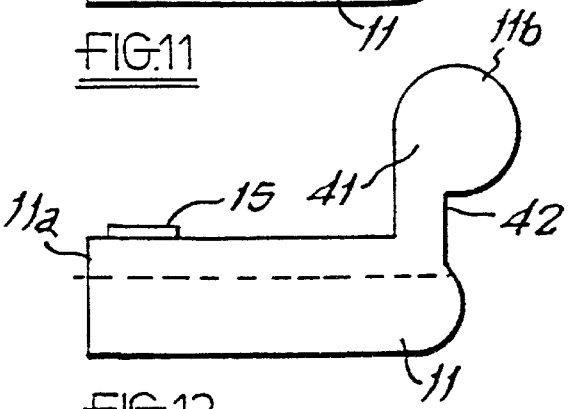
FIG. 12 is another section having a necked lateral projection.

FIGS. 7 and 12 show tape like those of FIGS. 6 and 11, but with different necking arrangements.

Figure 5:
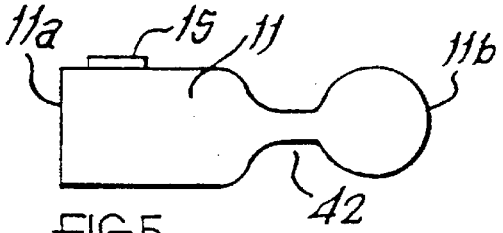
FIG. 5 is a section having a necked tapered end.

FIG. 5 shows a tape like that of FIG. 1, but with the tapered end 11*b* necked at 42.

Figure 13:
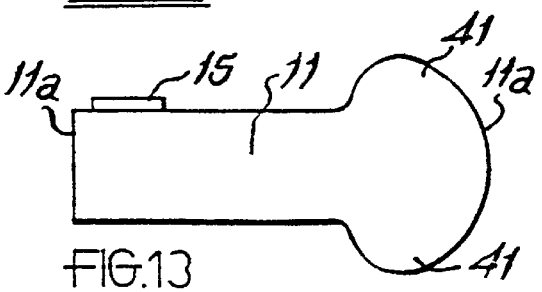
FIG. 13 is a section having lateral projections from both faces.

FIG. 13 shows a tape with adhesive 15 on one face only and lateral extensions 41 from each face at its tapered end 11*a*.

Figure 9:
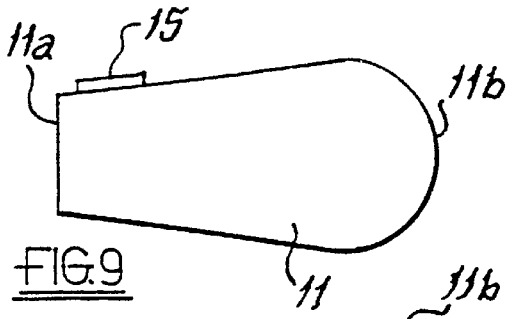
FIG. 9 is a section having a slightly trapezoidal section.

FIG. 9 shows a tape with a slight taper towards its end 11*a* bearing the adhesive 15, so that it has a slight trapezoidal or airfoil section.

All of these variants may be preferred for one reason or another, However, all of them readily lend themselves to the method for masking the unsealed automobile door or like opening (e.g. bonnet, boot or tailgate) in which the tape 11 is attached by its adhesive strip 15 as described above, its lateral projection 41 being then automatically positioned to project around the edge of the door or other opening member to project between the edge and fixed structure of the vehicle when the door or member is closed—the lateral projection, or the "bead" formed at the end 11*b* by the necking 42, being useful as a guide to where to attach the adhesive strip 15.

FIGS. 14 to 22 of the drawings illustrate paint masking strips 111 comprising a body part 112 with adhesive 113 for attachment to a workpiece and a readily separable part 114. The strips 111 are made of open-cell foam material.

The separable part 114 comprises in all illustrated embodiments a tear-off part, though there is, of course, no reason why any other method of removal, such as cutting or dissolving a water soluble join, may not be used, other, obviously, than expense and general convenience considerations.

Figure 16:
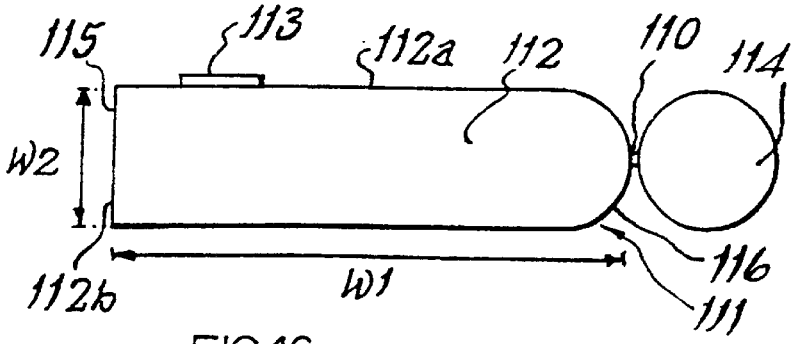
FIG. 16 is a section through a second embodiment of separable masking strip.

The tear-off part 114 may be integral with the body part 112, joined by a thin web 110—see FIG. 16. However, the tear-off part 114 may be adhesively attached to the body part 112 as shown in FIGS. 17 to 20.

Figure 14:
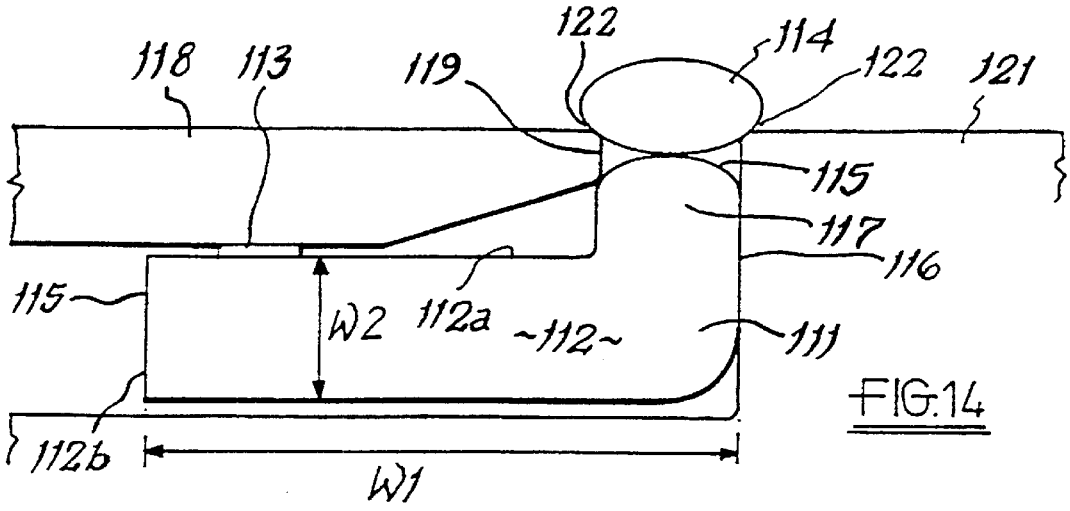
FIG. 14 is a section of a first embodiment of separable masking strip in use masking a door and surround for painting.
Figure 15:
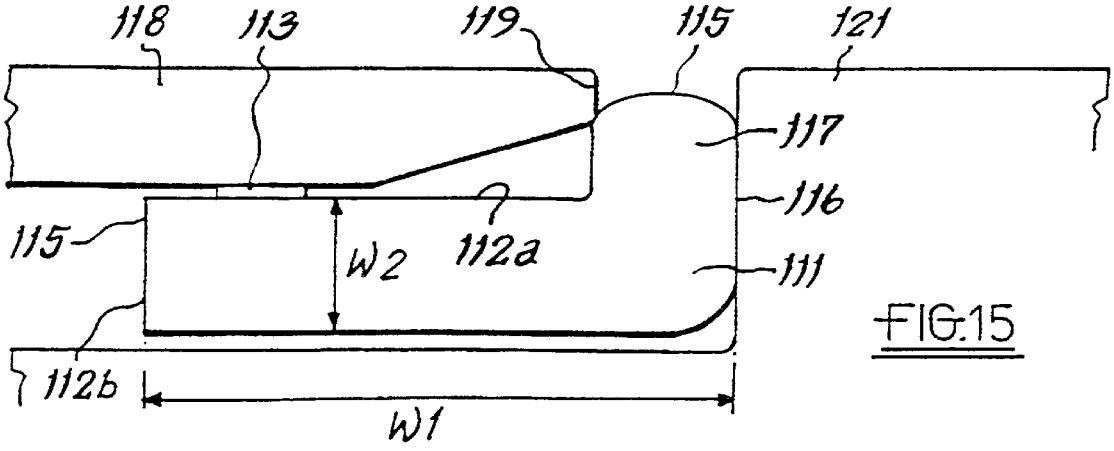
FIG. 15 is a section like FIG. 14 of the same masking strip at a later stage of the painting procedure.

The body part 112 as seen in FIGS. 14 to 16 has an oblong cross-section with a strip of adhesive 113 at one edge 115 of a wider face 112*a*, the separable part 114 being at the other edge 116 of said face. The width W1 of the wider face 112*a* is about four to five times the width W2 of the narrower face 112*b*—it is required that the strip be thick enough (i.e. the width W2 of the narrower face is sufficient) to provide an effective seal against ingress of paint into the interior of the vehicle, while the width W1 of the wider face 112*a* is sufficient to allow the adhesive strip 113 to be attached to an available surface while the edge remote from the adhesive is in the region of the gap between door and surround.

In the embodiments of FIGS. 14 to 16, the edge 116 of the body part 112 remote from the adhesive 113 is tapered—in fact, it is rounded, though it could also be multi-faceted.

In the embodiments of FIGS. 14 to 16, the tear-off part 114 is a bead of width equal to the width W2 of the narrower face 112*b* of the body part 112. It is not necessary that it be exactly so—its size limits will be determined from considerations below for any particular application.

FIGS. 14 and 15 illustrate a strip 111 in which the body part 112 has a lateral projection 117 from the face 112*a* which bears the adhesive 113 and at the opposite edge of said face. The separable part 114 is on that lateral projection 117. This lateral projection is helpful in locating the strip on first application, the projection 117 being positioned at the edge 119 of the door 118, the adhesive strip 113 being pressed on to the door 118 where it sits after positioning the projection 117.

The embodiment of FIG. 16 is similar, but without the lateral projection 117. In use, the tapered edge of the body part would be deformed on closing the door to a configuration very like the one shown in FIG. 15.

The embodiments of FIGS. 14 and 16 are used in similar fashion. As seen in FIG. 14, the body part 112 is attached to the inner face of the edge of the door—all the way around the edge, the foam material being readily bendable—with the lateral projection at the edge 119 of the door 118 as explained, and the bead 114 projecting across the edge 119 so that when the door 118 is closed on the door surround 121, as in FIG. 14, the bead 114 covers the opening.

Primer coat is now sprayed on to doors and surround, areas such as windows being masked by conventional masking tape. The bead 114 prevents ingress of primer past the edge 119 of the door 118.

In the spraying process, paint tends to build up in bights as at 122 between the edge 119 of the door 118 and the bead 114 and the surround 121. Any such build up, however, is absorbed by the open-cell foam bead.

After the primer coat is applied, the bead 114 is removed This can be done without undue disturbance of the body part 112, which can, however, be readily readjusted by finger pressure to lie uniformly within the gap between door and surround.

The top coat can now be applied, the body part 112 now performing the usual function of masking strip in preventing the paint entering the vehicle interior. As, however, the only adhesive area is not in the region to which the paint is applied, there is no tendency for paint build up, any excess being absorbed by the open-cell foam material.

This masking technique is well adapted for the time-saving "wet-on-wet" spraying technique in which a thin coat of primer is applied and, without waiting the usual drying time, the top coat is applied straight away.

FIGS. 17 to 20 illustrate adaption of the commercially available "twin-track" masking tape to the invention.

Figure 17:
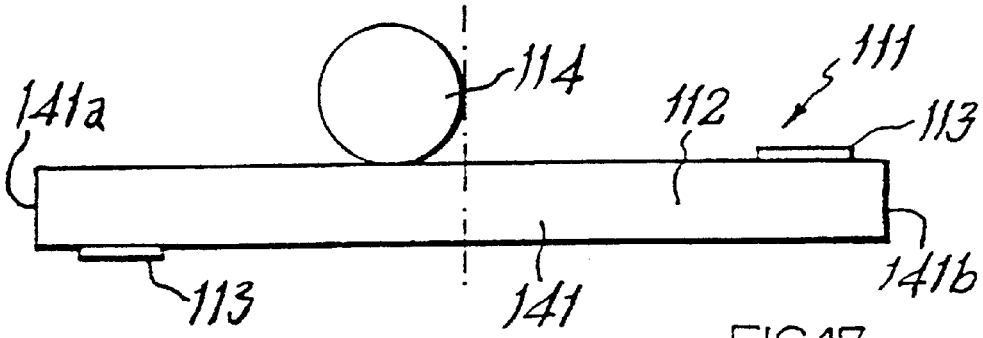
FIG. 17 is a section through a third embodiment of separable masking strip.
Figure 18:
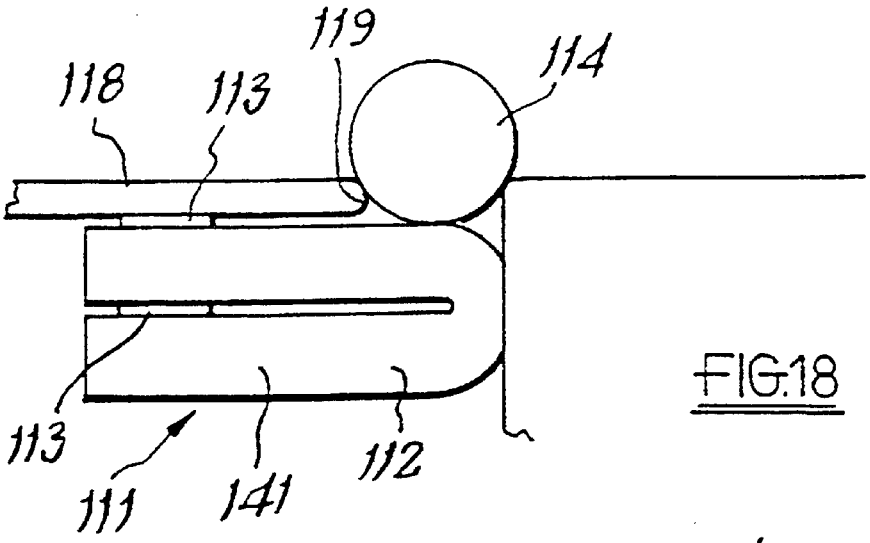
FIG. 18 is a section through the embodiment of FIG. 17, deployed in masking a door/surround.

FIG. 17 is a cross-section of a twin-track tape 141 which has adhesive strips 113 either edge but on opposite faces. Closer to the edge 141*a* of the face of the tape 141 bearing the adhesive at the edge is adhesively secured a bead 114. In use, as seen in FIG. 18, the tape is attached to the door 118 so that the bead 114 is at the edge 119 of the door and the tape 141 folded back to attach the other adhesive strip 113 on edge 141*b* to the edge 141*a*. The primer can now be sprayed, the bead 114 removed and the top coat applied.

Figure 19:
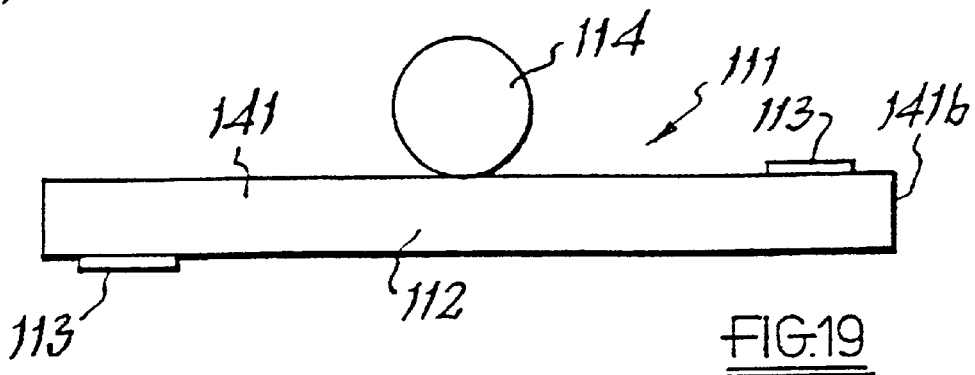
FIG. 19 is a section through a fourth embodiment of separable masking strip.
Figure 20:
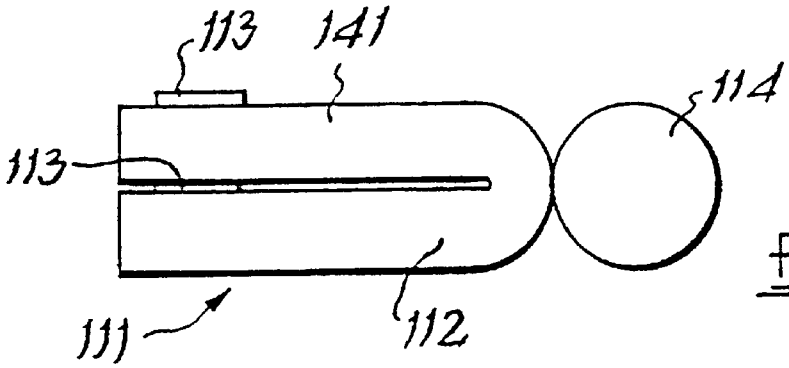
FIG. 20 is a section through the embodiment of FIG. 19, deployed masking a door/surround.

FIGS. 19 and 20 show a version in which the bead 114 is centrally located on the tape 141, the tape being bent (as with the embodiment of FIG. 16) by the act of closing the door into the correct configuration.

Figure 21:
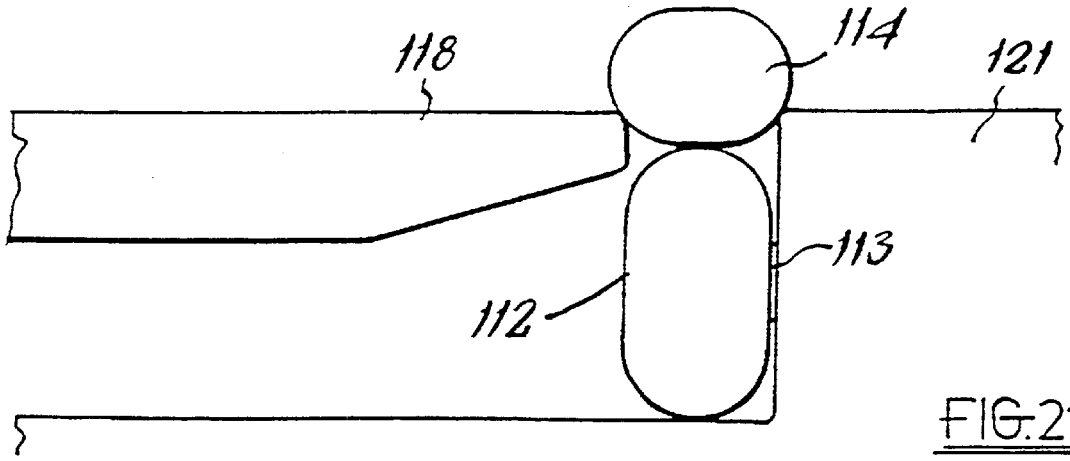
FIG. 21 is a section through a fifth embodiment of separable masking strip.
Figure 22:
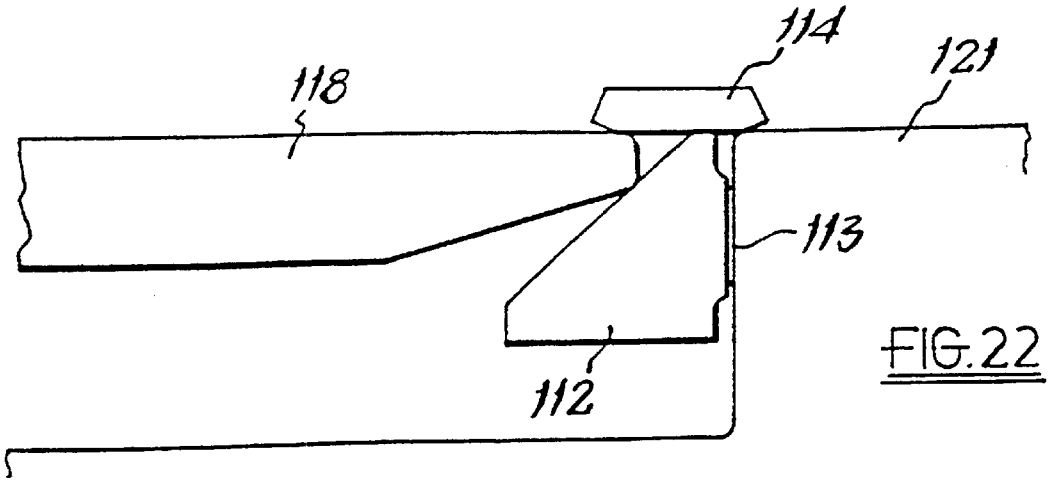
FIG. 22 is a section through a sixth embodiment of separable masking strip.
Figure 23:
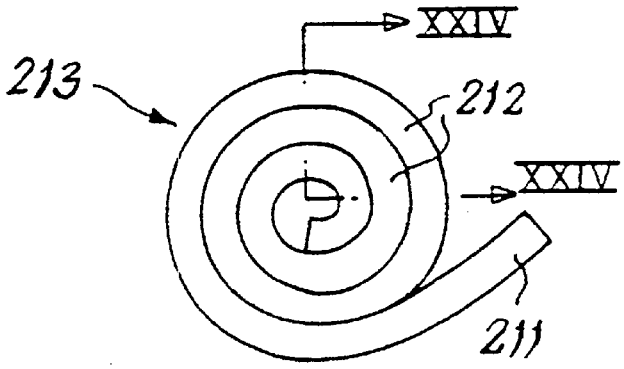
FIG. 23 is a view of a foam product stored in roll form.

FIG. 21 shows a version in which the body part 112 is itself a simple bead, the readily separable part 114 being a smaller bead. The body part 112 has adhesive 113 for attaching it to the door surround 121. FIG. 22 shows a version in which the body part 112 has a generally triangular cross-section, the readily removable part 114 being of flat cross-section.

Figure 24:
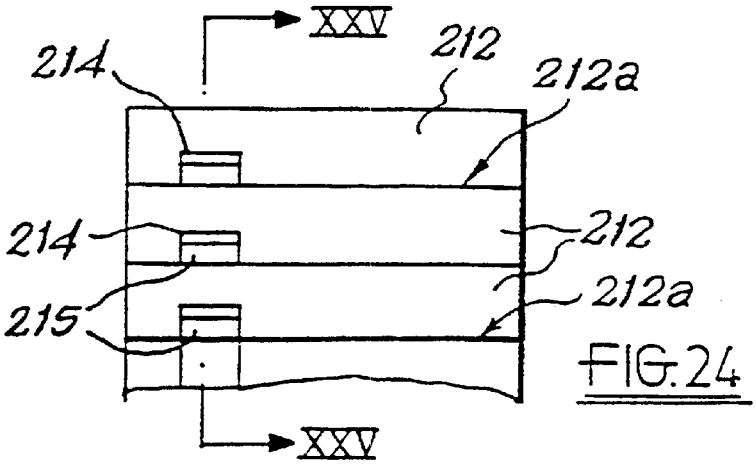
FIG. 24 is an enlarged section on line XXIV—XXIV of FIG. 23.
Figure 25:
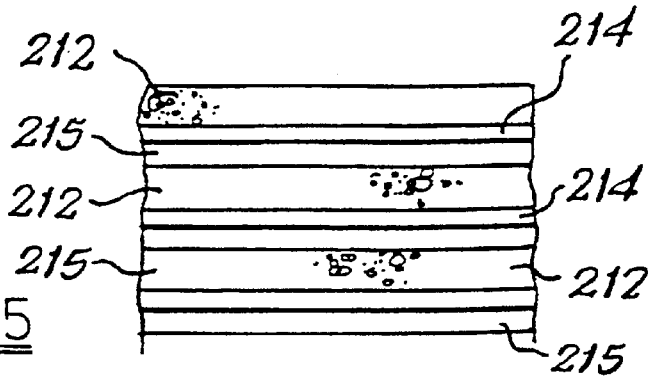
FIG. 25 is a section on the line XXV—XXV of FIG. 24.

FIGS. 24 to 25 of the drawings illustrate vehicle paint foam masking tape 211 stored in layers 212 on a roll 213 and having an adhesive 214 by which it is adapted, in use, to be attached to a surface, the adhesive 214 being so arranged as to be between adjacent layers 212 but out of contact with the next adjacent layer 212 in the roll 213.

To this end, the adhesive 214 is on the base of a groove 215 extending along the tape 211. Alternatively, the adhesive 214 could be on the face 212*a* of the layers 212 opposite the groove 215. In the latter case, the tape 211 is perfectly normal except for having a groove 215 which in use has no great effect. If the adhesive is on the base of the groove it is only necessary to ensure that the groove is not so deep as precludes ordinary tape application pressure from popping it out to contact the surface to which the tape 211 is to be applied. Surface application, of course, does not require the foam to be compressible. While the roll storage format has been described, clearly the same considerations apply to stack storage and FIGS. 24 and 25 can be taken as illustrative thereof. Stack storage might not be used for masking tape (usually required in e.g. 5 m lengths). Stacking might be appropriate where the products are required all to be cut to a certain length or where rolling is impracticable because of size, thickness etc. For example, mattress or cushion inners might be adhesively secured to covering layers and be stacked after application of the adhesive for transportation to a covering station.

This method of tape/adhesive separation can be applied to masking tape as described with reference to and illustrated in FIGS. 1 to 22 as well, of course, as sundry other compressible foam products such as stacked insulating foam sheets for interlinings.

What is claimed is:

1. A method for masking during painting the outer face of a door in a door surround comprising attaching a mask between a door and a surround to seal against penetration of paint through a door opening, wherein the mask comprises an elongate substantially rectangular foam section having a major dimension that is at least twice but not more than four times its minor dimension, the rectangular section comprising a first end, an opposed second end, a top face, and a bottom face wherein a first adhesive strip is attached to either the first end, the top face, or the bottom face for attachment to the door, and an integrally connected readily removable foam part is connected to the substantially rectangular foam section by a second adhesive strip or a thin web on the second end or spaced away from the first adhesive strip on the top or bottom face, the mask having a readily removable part which protrudes from between an edge of the door and the surround, painting the door and surround with a first coat of paint, removing the readily removable part of the mask, then painting the door and surround with a second coat of paint while the first coat of paint is still wet.

2. A method as defined in claim 1, wherein the substantially rectangular foam section comprises a foam tape.

3. A method as defined in claim 2, wherein the first adhesive strip is attached to the first end of the rectangular foam section and the readily removable foam part is attached to the second end of the rectangular foam section.

4. A method as defined in claim 2, wherein the readily removable part of the mask is a tear off part.

5. A method as defined in claim 2, wherein the substantially rectangular foam section comprises and a lateral projection located on the upper or lower surface of the rectangular section the lateral projection defining the readily removable part.

6. A method as defined in claim 5, wherein the lateral projection has a length that is substantially the same as the minor dimension of the substantially rectangular foam section.

7. A method as defined in claim 5, wherein the elongate substantially rectangular section includes an adhesive on the top or bottom face, the lateral projection projecting from the same face as the adhesive.

8. A method as defined in claim 5, wherein the lateral projection is necked.

9. A method for masking an unsealed automobile opening comprising:

attaching a masking foam tape around an inner edge of an open opening member so as to project around the member beyond a rim thereof, said foam tape having an elongate substantially rectangular section, the substantially rectangular section having a substantially uniform thickness in between opposing side walls, the rectangular section having a first end and a second and opposite end, the rectangular section having a major dimension at least twice but not more than four times its minor dimension, the first end of the rectangular section including an adhesive for attachment at the opening, the second end of the rectangular section tapering in from the opposing side walls and being free of adhesive, the second end projecting beyond the rim of the opening member;

closing the opening member to position the second end of the tape between the member and surround; and manually adjusting the second end of the tape to evenly accommodate around the rim.

10. A method as defined in claim 9, further comprising the step of painting the opening member after manually adjusting the second end of the tape.

11. A method as defined in claim 9, wherein the foam tape has a shape that consists essentially of the elongate substantially rectangular section.

12. A method as defined in claim 9, wherein the second tapered end of the rectangular section comprises a rounded end.

13. A method as defined in claim 9, wherein the second tapered end of the rectangular section comprises a faceted end.

14. A method as defined in claim 9, wherein the adhesive is positioned at the first end of the rectangular section along one face of the foam tape.

15. A method as defined in claim 9, wherein the major dimension of the elongate substantially rectangular section is about 25 mm.

16. A method as defined in claim 9, wherein the minor dimension of the elongate substantially rectangular section is about 10 mm.

17. A method as defined in claim 9, wherein the elongate substantially rectangular section bends around the rim of the opening member when the opening member is closed.

18. A method as defined in claim 9, wherein the elongate substantially rectangular section is substantially linear.

19. A method for painting the outer surface of a door comprising the steps of:

attaching a masking foam tape to an inside surface of a door, the masking foam tape projecting beyond an edge of the door, the foam tape having an elongate substantially rectangular section, the rectangular section having a first end and a second and opposite end, the substantially rectangular section having a substantially uniform thickness in between opposing side walls, the rectangular section having a major dimension at least twice but not more than four times its minor dimension, the second end of the rectangular section tapering in from the opposing side walls, the masking foam tape including an adhesive strip for attaching the tape to the door;

closing the door to position the second end of the tape between the door and the door surround, wherein the elongate substantially rectangular section bends around the edge of the door when the door is closed;

manually adjusting the second end of the tape to evenly accommodate around the edge of the door; and painting the door after manually adjusting the second end of the tape.

20. A method as defined in claim 19, wherein the elongate substantially rectangular section is substantially linear.

21. A method for painting an unsealed automobile opening comprising;

attaching a masking foam tape around an inner edge of an opening member so as to project around the member beyond a rim thereof, the foam tape having an elongate section, the foam tape including a first end and a second end, the foam tape further including an adhesive for attaching the foam tape to the inner edge of the opening member;

closing the opening member to position the second end of the foam tape between the member and a surround;

applying a first coat of a paint to an outside surface of the opening member;

adjusting the second end of the tape between the opening member and the surround; and applying a second coat of a paint to the outside surface of the opening member, the second coat of the paint being applied while the first coat of the paint is still wet.

22. A method as defined in claim 21, wherein the foam tape includes a readily removable part positioned at the second end of the tape, and wherein the foam tape is adjusted in between the first coat of paint and the second coat of paint by removing a readily removable part.

* * * * *